United States Patent [19]

Koeller

[11] 3,994,424

[45] Nov. 30, 1976

[54] CAN GUARD

[75] Inventor: William H. Koeller, Berkeley, Ill.

[73] Assignee: Lawrence Peska Associates, Inc., New York, N.Y. ; a part interest

[22] Filed: June 9, 1975

[21] Appl. No.: 585,365

[52] U.S. Cl. ..... 222/570

[51] Int. Cl.[2] ..... B65D 5/74

[58] Field of Search ..... 222/570, 569; 220/95, 220/91, 92

[56] References Cited

UNITED STATES PATENTS

| | | | |
|---|---|---|---|
| 1,682,048 | 8/1928 | Levien | 222/95 X |
| 2,331,971 | 10/1943 | Gramp | 222/570 |
| 3,853,249 | 12/1974 | Weir, Jr. | 222/570 |

*Primary Examiner*—Allen N. Knowles
*Assistant Examiner*—Norman L. Stack, Jr.
*Attorney, Agent, or Firm*—Eugene V. Mandel

[57] ABSTRACT

A can guard comprising a peripheral lip, a pouring spout, and handle clearance cutouts.

10 Claims, 2 Drawing Figures

CAN GUARD

BACKGROUND OF THE INVENTION

This invention relates to protective devices used about the top of an open can to catch drippings and excess. Any open can which is used to dispense liquid material from its contents, soon accumulates excess material about the pouring spout, around the rim, on the outside, and underneath the can. What a Mess!

The excess material underneath the can leaves marks on any surface upon which the can rests. Often, one can see a full ring mark left upon floors and furniture.

Excess material on the outside of the can wipes off on legs, pants, hosiery, and other contacting surfaces including pet animals like dogs and cats. Excess material accumulating at the top of the can, and in the rim, dries out and makes it difficult to reclose the can. Failure to securely reclose the can causes the gradual evaporation and deterioration of the can's contents.

Often a brush is used to dispense and apply the material. To preclude general dripping, excess material on the brush is often wiped off on the rim of the can, aggravating the condition of accumulated and dried material in the rim.

Users of such cans, including house painters, often carry a cloth to wipe off the can, to place under and around the can. A careful housepainter is concerned about slopping and dripping paint on the floors as he moves from room to room.

It is an object of this invention to reduce the probability of slopping liquid over the edge in carrying an open can. It is a further object to provide a pouring spout to improve control of pouring and thereby to reduce spillage. It is another object to provide a place to safely wipe off the excess from a brush. And also to protect the can rim from becoming clogged with accumulated liquid.

The essence of this invention is a guard to fit about the top of a can, provided with raised edges and a pouring spout.

Further objects and advantages of this invention will appear more clearly from the following description of a non-limiting illustrative embodiment and the accompanying drawings in which like numerals designate like parts thruout the several views.

DESCRIPTION OF TYPICAL EMBODIMENT

Figure 1:
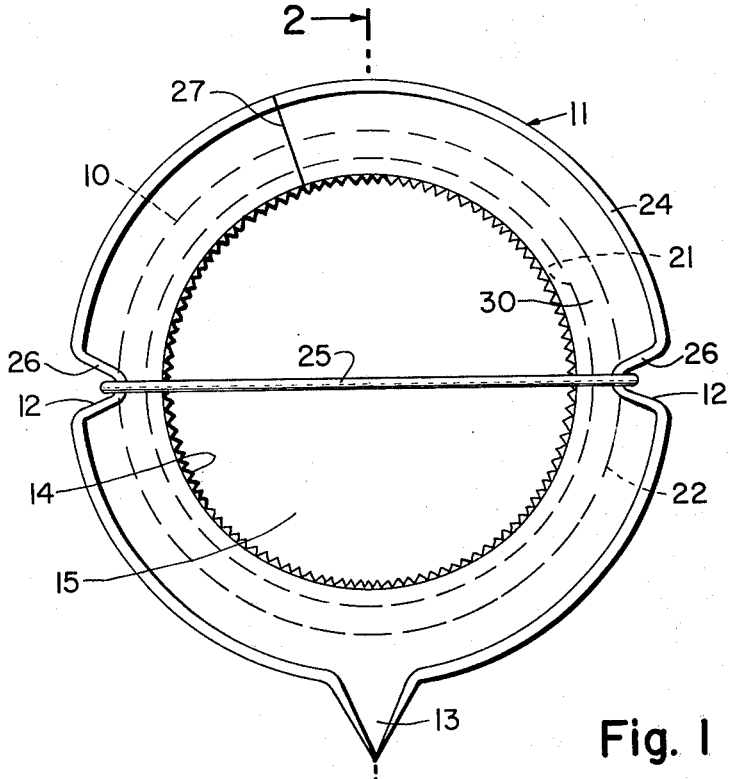
FIG. 1 shows a top plan view of an open can with a can guard installed.
Figure 2:
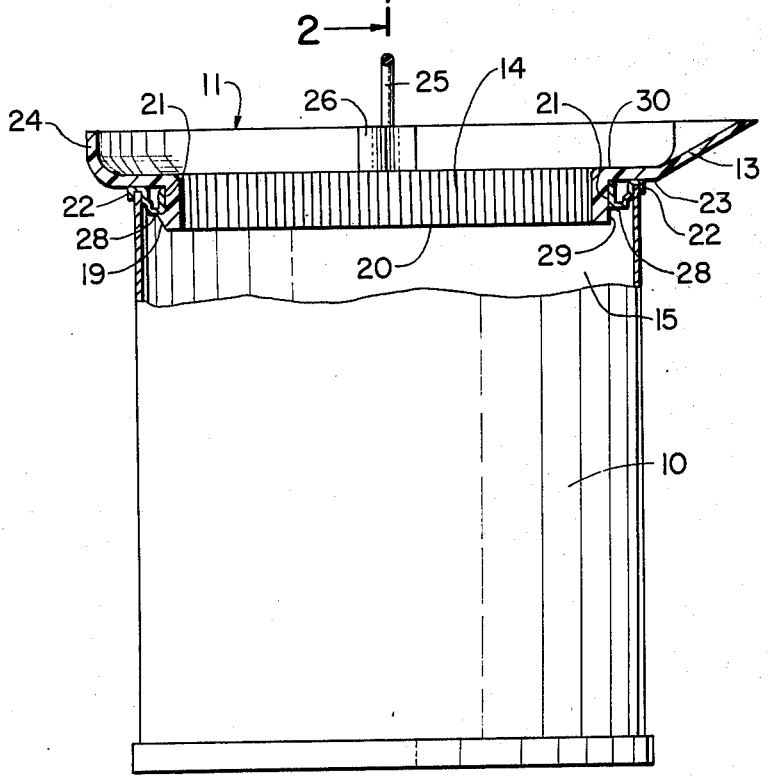
FIG. 2 is an elevation view in partial section of an open can with a can guard installed.

A can 10 having a rim defined by its inner edge 21 and its outer edge 22 and sometimes provided with a handle or bail 25 has a guard 11 assembled to it. The guard 11 has a pouring spout 13 formed in the guard's upright outer edge 24. The guard 11 consists essentially of a peripheral lip around the top of the can having a substantially horizontal part 30, an inner vertical descending surface 14 and outer upward surface 24.

The guard 11 may be provided with a split 27 to permit the guard to be more easily assembled to or removed from the can 10. The guard 11 would usually have cutouts 12 to clear a handle or bail 25. The edges of cutout 12 should have ridges 26 to reduce liquid spilling out.

Surface 23 of the guard 11 rests on top of the can 10 rim. The bottom 20 of the inside of the guard would preferably extend below the bottom 28 of the can rim.

The part of the guard fitting inside the hole 15 is usually straight down as at 29.

To secure the guard, the bottom of the guard can be provided with a outwardly projecting portion or lip 19 to hook under the bottom 28 of the rim. To permit easier fitting of the guard inside the rim, downward surface 14 can have small grooves. These grooves will also help control the flow of the returning excess liquid.

The invention includes all novelty residing in the description and drawings. It is obvious to those skilled in the art that various minor changes can be made without departing from the concept of this invention and all such as fall within the reasonable scope of the appended claims are claimed.

What is claimed is:

1. In a device for use with the open end of a can which may have a can bail handle, a guard comprising a peripheral lip around the top of the can, said lip extending outwardly and upwardly from the outer edge of the can rim, and inwardly and downwardly relative to the inner edge of the can rim, said lip being cut out by opposed inward projections of the lip providing clearance openings therethrough to permit the upward projection of the can bail handle elements within the outer periphery of the outwardly projecting lip, and a portion of the outer part of said lip being formed into a pouring spout.

2. A device as in claim 1 in which the inner downward portion is ridged to provide flexibility.

3. A device as in claim 1 in which the pouring spout is located approximately 90° around the can from the clearance cutouts.

4. A device as in claim 1 provided with a split to permit assembly to the can about the can handle.

5. A device as in claim 1 made of metal.

6. A device as in claim 1 made of plastic.

7. A device as in claim 1 made of paper composition.

8. A device as in claim 1 provided with raised edges around the cutout to clear the can handle.

9. A device as in claim 1 in which the inward downward part of the lip is provided with small grooves.

10. A device as in claim 1 in which the inward downward part of the lip terminates in an outward projecting portion.

* * * * *